US006443071B2

(12) United States Patent
Boivin

(10) Patent No.: US 6,443,071 B2
(45) Date of Patent: Sep. 3, 2002

(54) DRIVE BOGIE FOR A RAIL WAY VEHICLE AND RAIL WAY VEHICLE EQUIPPED WITH SUCH A BOGIE

(75) Inventor: Gilbert Boivin, St. Pierre de Varennes (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 09/758,125

(22) Filed: Jan. 12, 2001

(30) Foreign Application Priority Data

Jan. 12, 2000 (FR) ..... 0000352

(51) Int. Cl.[7] ..... B61F 3/00

(52) U.S. Cl. ..... 105/182.1; 105/157.1; 105/96

(58) Field of Search ..... 105/49, 133, 136, 105/157.1, 167, 194, 199.1, 453, 45 R, 96, 182.1

(56) References Cited

U.S. PATENT DOCUMENTS 4,170,945 A * 10/1979 Kayserling ..... 105/131
4,278,028 A * 7/1981 Eichinger et al. ..... 105/136

FOREIGN PATENT DOCUMENTS

EP 0357564 A2 * 3/1990
EP 589866 A1 * 3/1994
EP 0 589 866 A 3/1994
FR 2 374 194 A 7/1978
FR 2 426 600 A 12/1979
FR 2426600 A * 12/1979
FR 2691422 A1 * 11/1993

* cited by examiner

*Primary Examiner*—S. Joseph Morano
*Assistant Examiner*—Frantz F. Jules
(74) *Attorney, Agent, or Firm*—Sughrue Mion, PLLC

(57) ABSTRACT

A drive bogie includes axles, a chassis and a device for driving each axle, including a motor, a reduction gearbox and a transmission coupling between the motor and the reduction gearbox, with a support mechanism being provided to allow the vehicle to support the drive device. The support mechanism for supporting the drive device comprises a suspension for suspending the reduction gearbox from the body of the vehicle, the suspension being articulated to the reduction gearbox or to the body, a device for articulating the motor to the chassis of the bogie about a roughly horizontal axis, and a device for connecting the motor to the reduction gearbox, the connecting device being articulated both to the motor and to the reduction gearbox. Thus, most of the mass of the reduction gearbox and of the motor is suspended vertically from the body of the vehicle.

19 Claims, 5 Drawing Sheets

DRIVE BOGIE FOR A RAIL WAY VEHICLE AND RAIL WAY VEHICLE EQUIPPED WITH SUCH A BOGIE

BACKGROUND OF THE INVENTION

The present invention relates to a drive bogie for a rail vehicle and to a rail vehicle equipped with at least one such bogie.

Customarily, a drive bogie comprises axles resting on the rails of the track and supporting a chassis, with the interposition of a suspension known as the primary suspension. The body of the railway vehicle rests on the chassis of this bogie, with the interposition of a suspension known as the secondary suspension.

Each drive bogie is fitted with means for driving each axle, which means comprise at least one motor and at least one reduction gearbox equipped with a wheel for driving the corresponding axle. There are also means allowing the railway vehicle to support the motors and the reduction gearboxes.

It is advantageous to have the mass of the drive means supported by a mechanical part of the vehicle which is as suspended as possible. This plays a part in reducing the loadings exerted on the rails by the drive bogie and makes it possible to increase the speed of the railway vehicle. From this standpoint it is preferable to have the masses of the motors and of the reduction gearboxes supported by the body of the vehicle and, failing that, by the chassis of the bogie, the solution of having the axles support these masses being the most unfavorable solution.

Incidentally, the body of the vehicle, the chassis of the bogie and the axles are free to move with respect to one another. Now, as the drive wheel of the reduction gearbox has to be secured to the axle, the higher up the members from which the motor and the reduction gearbox are suspended, the more complex will be the transmission between the suspended motor and this drive wheel fixed to the axle.

A compromise has therefore to be found between suspending these masses solely from the axle, which is simple to implement but which allows only low speeds, and suspending the masses from the body, which allows high speeds but which is complex in technical terms.

A first solution consists in suspending a geared motor unit from the body of the vehicle and in installing an additional reduction gearbox on the axle, these two reduction gearboxes being connected by a constant-velocity joint. This solution does, however, have drawbacks in that it is necessary to use two separate reduction gearboxes. What is more, the use of a constant-velocity joint, which is particularly expensive, leads to high costs.

An alternative solution has been proposed. It consists in suspending the reduction gearbox from the chassis of the bogie, at the opposite end to the axle. Incidentally, the motor is fixed permanently to the chassis, the reduction gearbox and the motor usually interacting via a curved-tooth coupling.

This arrangement, although relatively advantageous in terms of cost, does have other drawbacks. Specifically, the masses of the motor and of the reduction gearbox are supported not by the body of the vehicle but by the chassis of the bogie, which means that the axles exert relatively high loads on the rails. What is more, mounting the motor permanently on the chassis leads to the emergence of high mechanical loadings exerted on this chassis.

SUMMARY OF THE INVENTION

In order to alleviate the various drawbacks of the prior art as mentioned hereinabove, the invention proposes to produce a railway vehicle drive bogie in which the masses of the motors and of the reduction gearboxes are supported, to a large extent, by the body of the vehicle, via a low number of mechanical parts which have a simple structure and are inexpensive.

To this end, the subject of the this invention is a drive bogie for a rail vehicle, intended to support a body of the said vehicle, the said drive bogie comprising axles resting on rails, a chassis resting on the said axles and means for driving each axle, including a motor, a reduction gearbox and means of transmission between the motor and the reduction gearbox, means being provided to allow the vehicle to support the drive means, characterized in that the said means for supporting drive means comprise means for suspending the reduction gearbox or the motor from the body of the vehicle, these means being articulated to the reduction gearbox or to the motor, and to the body, means for articulating the motor to the chassis of the bogie about a roughly horizontal axis, and means for connecting the motor to the reduction gearbox, these means being articulated both to the motor and to the reduction gearbox.

According to other features of the invention:

- when viewed from the side, the point of articulation of the reduction gearbox or of the motor to the suspension means lies between the center of gravity of the reduction gearbox and the center of gravity of the motor;
- the moment exerted by the reduction gearbox on the said articulation point is approximately equal to the moment exerted by the motor on this articulation point;
- when viewed from above, the reduction gearbox and the motor are transversely offset with respect to each other, the point of articulation of the suspension means to the reduction gearbox or to the motor being located between the center of gravity of the reduction gearbox and the center of gravity of the motor;
- the means for suspending the reduction gearbox or the motor from the body of the vehicle are articulated to the reduction gearbox or to the motor, and to the body, at least about a horizontal axis;
- the suspension means comprise an approximately straight connection rod stretching roughly vertically between the reduction gearbox and the body of the vehicle;
- the means of articulation of the motor to the chassis comprise two arms secured to the housing of the motor, these arms being articulated to the chassis about the said horizontal axis;
- the means for connecting the motor to the reduction gearbox are articulated to the motor and to the reduction gearbox at least about a horizontal axis;
- the means for connecting the motor to the reduction gearbox comprise a link rod which, when viewed from the side, is in the shape of a C, the two ends of this link rod, one of them articulated to the motor and the other to the reduction gearbox, being located roughly one below the other;
- the means of transmission between the motor and the reduction gearbox comprise a curved-tooth coupling;
- the reduction gearbox comprises a driven wheel driven by the motor, a drive wheel secured to the axle and an intermediate wheel.

Another subject of the invention is a railway vehicle comprising at least one drive bogie and a body resting on the or each drive bogie, characterized in that the or each drive bogie is as defined hereinabove.

BRIEF DESCRIPTION OF THE DRAWINGS

The invention will be described hereafter with reference to the appended drawings which are given merely by way of non-limiting examples, and in which.

DESCRIPTION OF THE PREFERRED EMBODIMENTS

Figure 1:
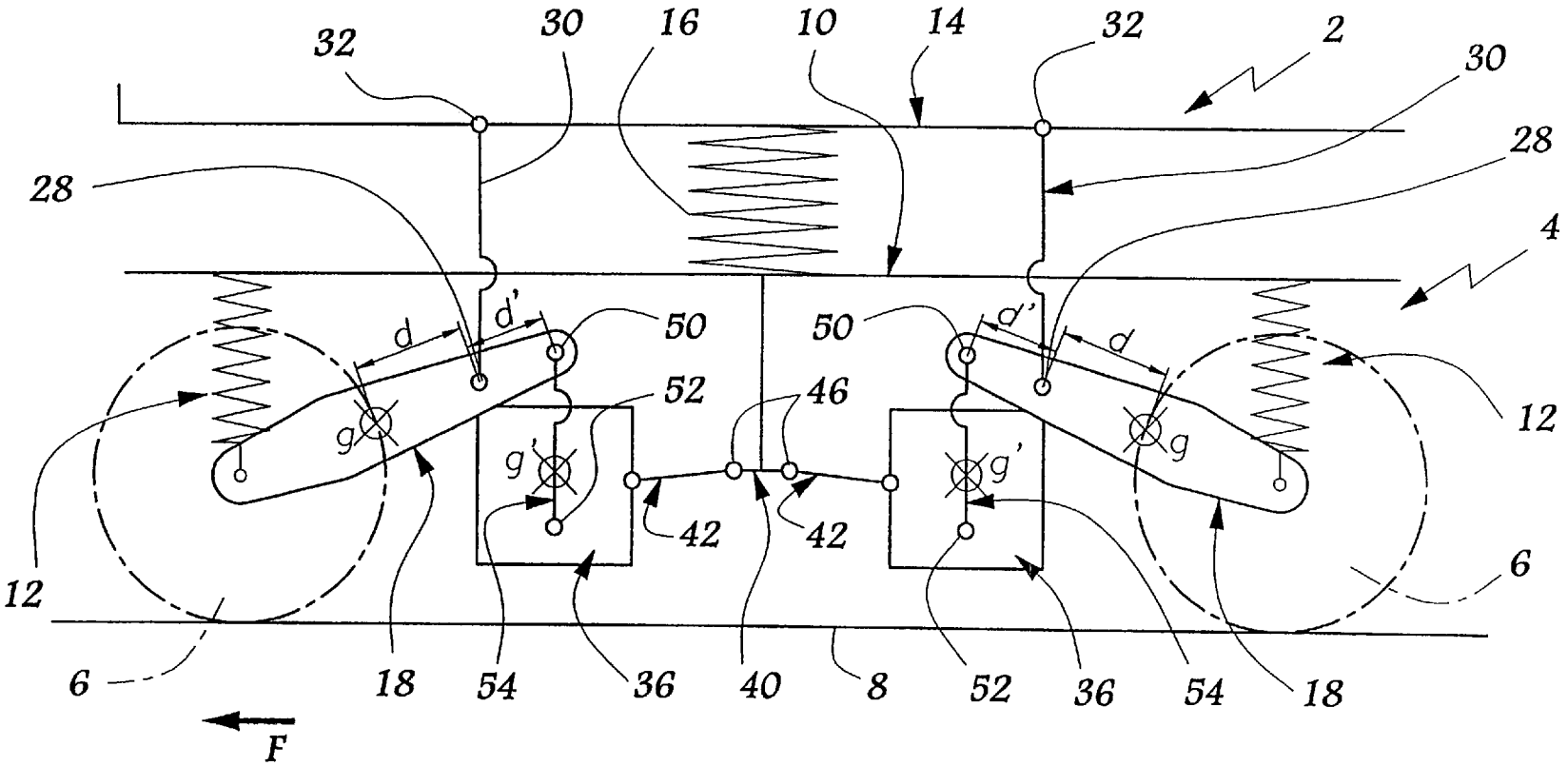
FIG. 1 is a diagrammatic view illustrating the distribution of mass of a drive bogie belonging to a railway vehicle according to the invention.

FIG. 1 diagrammatically depicts a railway vehicle denoted overall by the reference 2. This vehicle is equipped with a number of bogies, just one of which, 4, is illustrated in this figure. This bogie comprises two axles 6, resting on rails 8 and supporting a chassis 10 with the interposition of a primary suspension denoted by the references 12. The railway vehicle is also equipped with a body 14, depicted partially, resting on the chassis 10 of the bogie 4 with the interposition of a secondary suspension 16.

Figure 3:
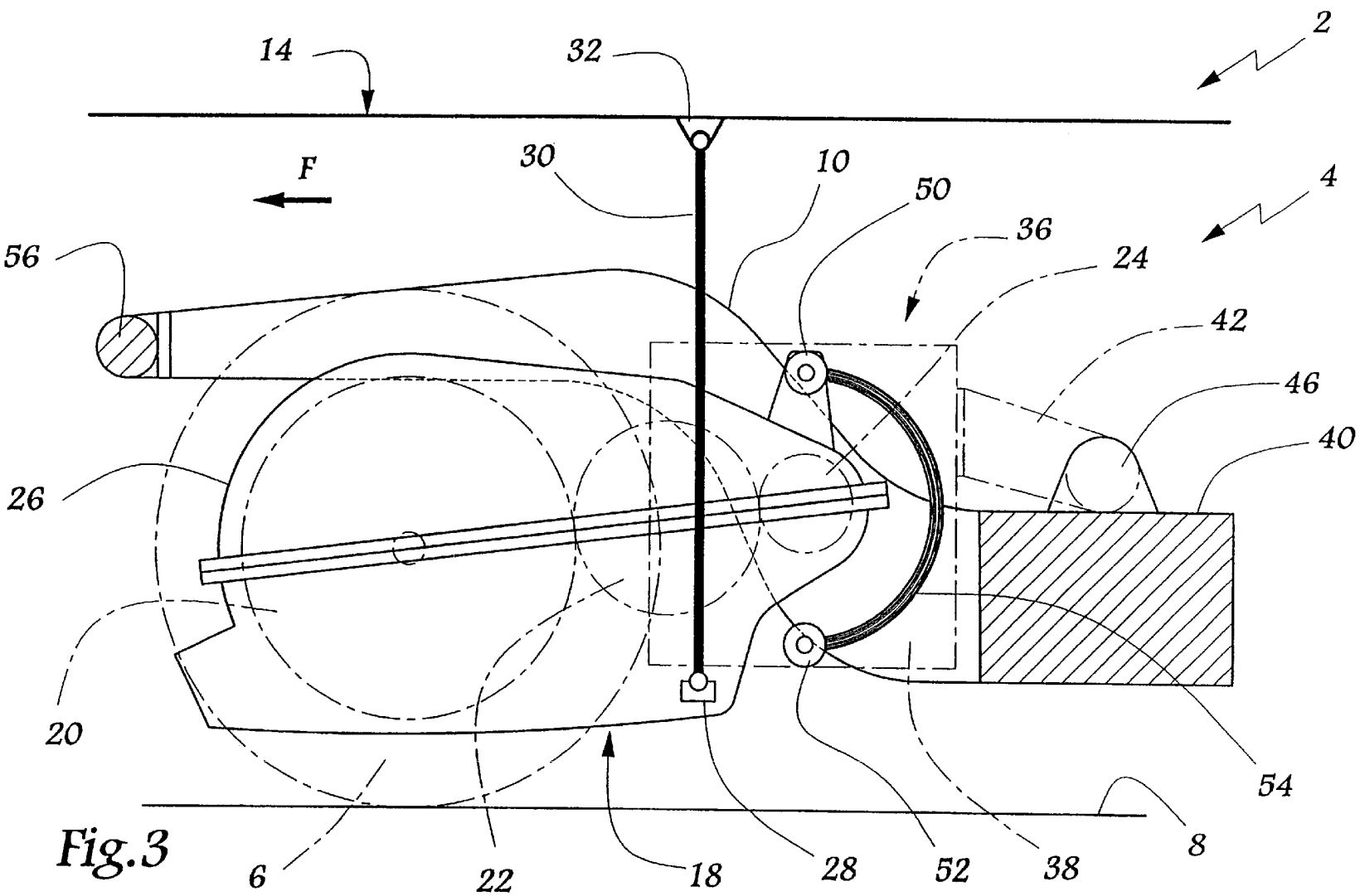
FIGS. 3 and 4 are views respectively from the side and from above, to a larger scale, of the drive bogie of FIG. 1.

Each axle 6 is equipped with a corresponding drive assembly. Only the drive assembly of the left-hand axle, in FIG. 1, will be described in what follows, it being understood that the two drive assemblies are symmetric with respect to a transverse central axis of the bogie. Each drive assembly comprises a reduction gearbox denoted overall by the reference 18, which is equipped with three gearwheels 20, 22, 24 illustrated in FIGS. 3 and 4. The wheel 20, secured to the axle, is a wheel for driving the latter, while the wheel 24 is a driven wheel driven by a motor, as will be explained in what follows, the wheel 22 being an intermediate wheel.

These wheels, 20, 22, 24, which are arranged one behind the other in the direction of forward travel F of the railway vehicle are housed in a box 26 which is formed with two half-elements, in the conventional way. The box 26 pivots about the axis of the axle 6, the drive wheel 20 is secured to the axle whereas the other two wheels 22 and 24 are borne by the box. The three axes of the wheels 20, 22, 24 are arranged in a plane which is slightly inclined to the horizontal, but may be arranged differently according to the layout of the bogie.

Figure 4:
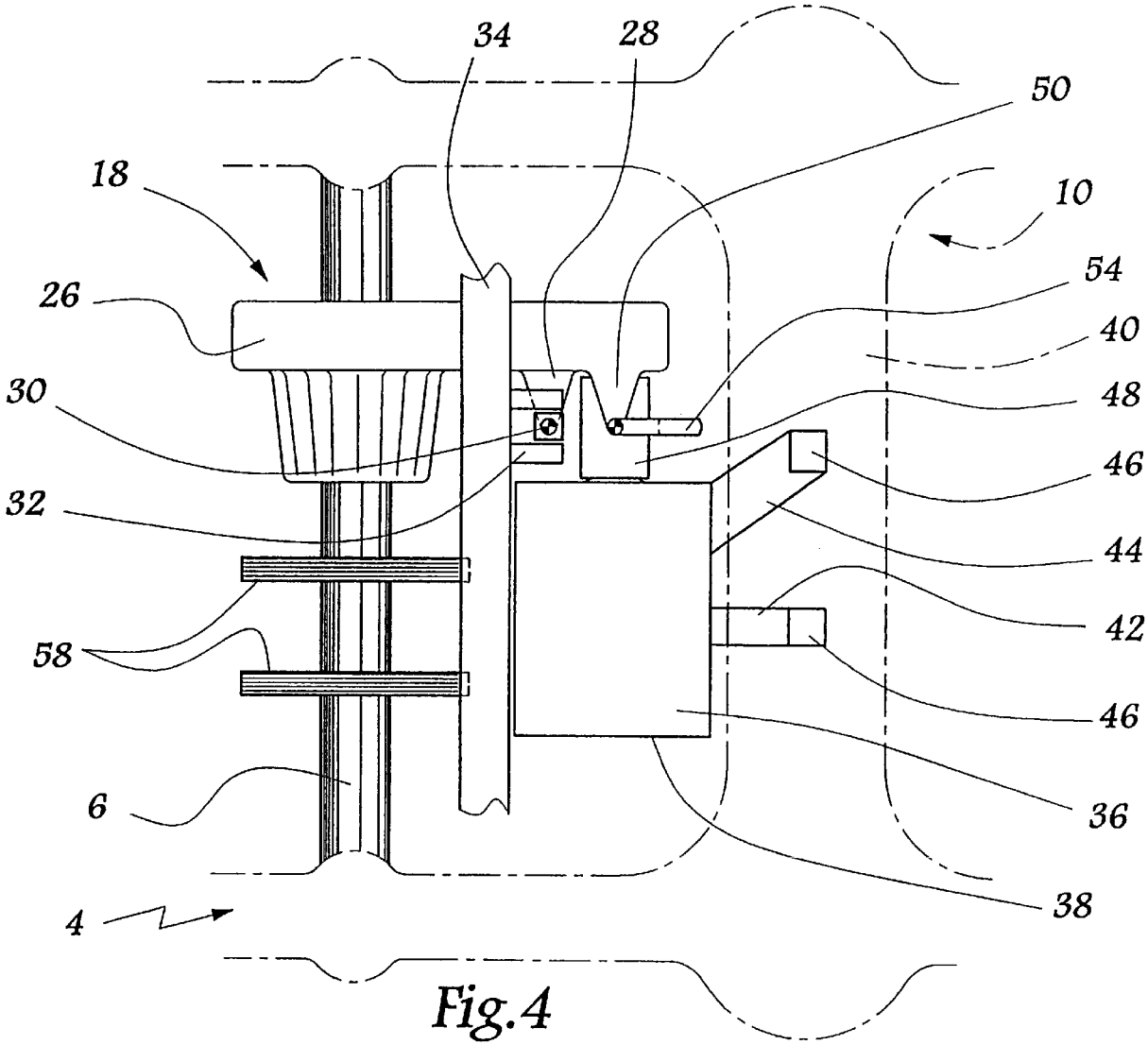

The box 26 has a projection 28 extending transversely, arranged towards the rear end of this box 26 away from the axle 6. A connecting rod 30 stretching roughly vertically, is mounted on spherical bearings both on the projection 28 of the box 26 and in a yoke 32 with which a cross member 34 of the body 14 is provided (FIG. 4). This connecting rod is depicted only in part in FIG. 2.

Each drive assembly also comprises a motor, denoted overall by the reference 36. This motor, which is powered by electrical means, not depicted, is housed in an approximately parallelepipedal housing 38. This motor, which is transversely offset with respect to the reduction gearbox 18, faces the opposite end of this reduction gearbox to the axle 6. For reasons of clarity, the motor is not depicted in FIG. 2 and has been depicted in chain line in FIG. 3.

The housing 38 is articulated, about a horizontal axis, to a cross member 40 of the chassis 10 of the bogie 4. For this purpose, the housing 38 is secured to two arms 42, 44 articulated to yokes 46 with which the cross member 40 is equipped. The first arm 42 stretches longitudinally while the other arm 44 stretches obliquely, it being understood that the arms 42, 44 may be parallel.

The rotational movement of the motor is transmitted to the driven wheel 24 by a curved-tooth coupling 48 of a conventional type.

At its opposite end to the axle 6, the box 26 is equipped with a flange 50 which projects both upwards and towards the motor. The latter, at its lower part, has a snout 52 which projects towards the reduction gearbox and comes vertically in line with the flange 50. The flange 50 and the snout 52 are located one on each side of the driven wheel 24. A link rod 54 is mounted, in spherical bearings, via its two ends, on the flange 50 and on the snout 52, respectively. When viewed from the side this link rod is in the shape of a C and stretches near to the coupling 48, on the opposite side thereof to the axle 6. This link rod allows the motor to be articulated to the reduction gearbox. Advantageously, the flange 50 and the snout 52 are arranged in such a way as to be aligned with the axis of the driven wheel 24, although a slight misalignment is acceptable.

Figure 2:
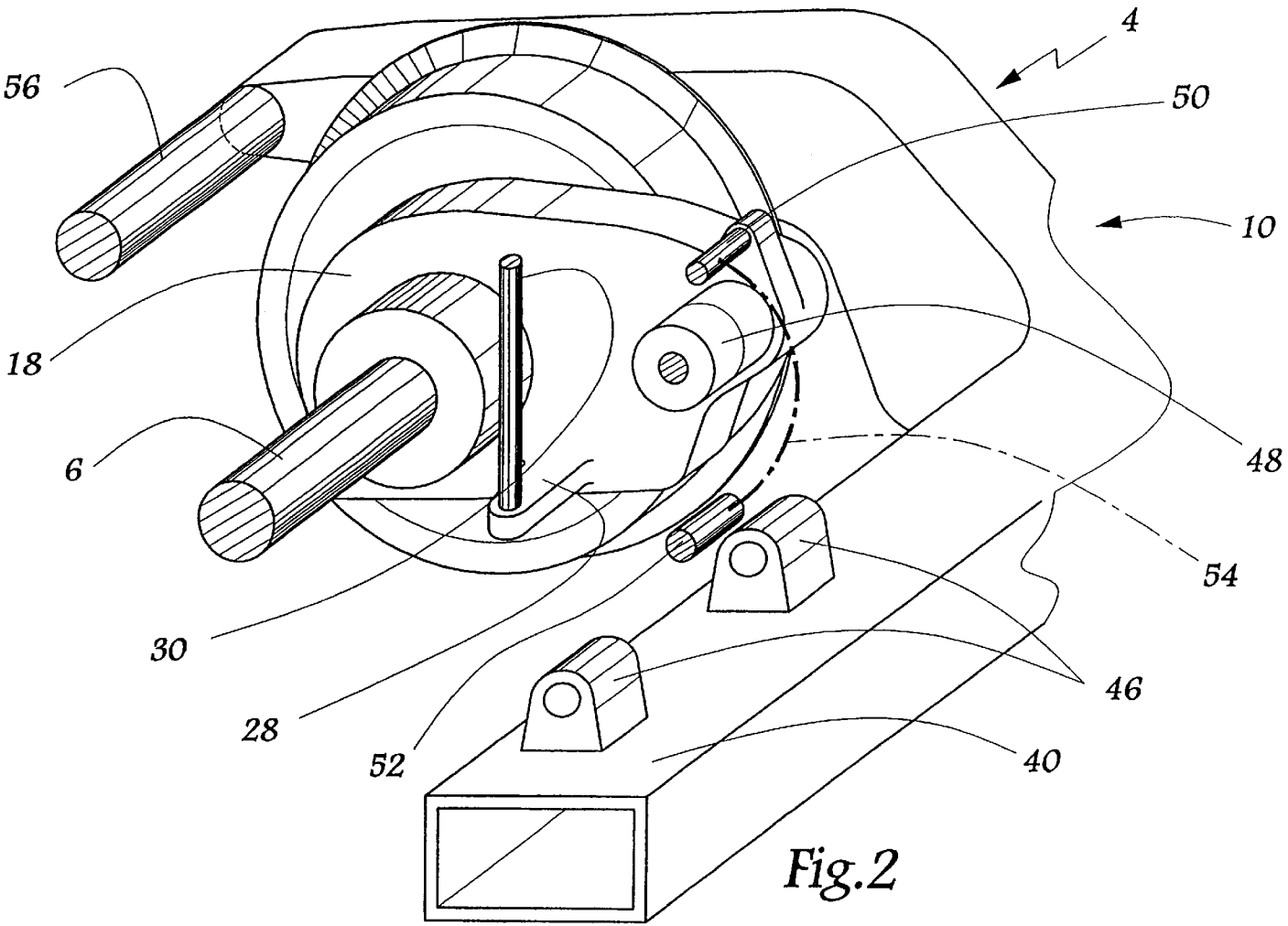
FIG. 2 is a perspective view of part of the drive bogie of FIG. 1.

As shown by FIG. 2, the chassis 10 of the bogie 4 is provided, on the opposite side of the axle 6 to the motor 36, that is to say at its front end, with a tubular cross member 56 equipped with a linkage, not depicted, for disc brakes. This linkage is able to collaborate with discs 58 secured to the axle 6 and visible in FIG. 4.

Referring again to FIG. 1, the center of gravity g of the reduction gearbox and the center of gravity g' of the motor 36 are located, when viewed from the side, one on each side of the projection 28 which constitutes the point of articulation of the reduction gearbox 18 to the connecting rod 30, and therefore to the body 14. Furthermore, the moment exerted by the reduction gearbox on this projection 28 is approximately equal to the moment exerted by the motor 36 on this same projection. In other words, the product of the mass m of the reduction gearbox and the distance d separating the center of gravity g from the projection 28 when viewed from the side is approximately equal to the product of the mass M of the motor and the distance d' separating, when viewed from the side, the projection 28 from the point of articulation of the motor to the reduction gearbox, namely the flange 50.

As also shown in FIG. 4, the centers of gravity g, g' are arranged, when viewed from above, one on each side of the projection 28 so that the latter lies pretty much at the center of inertia of the system formed by the motor and the reduction gearbox.

In service, the relative displacements transversely and in curves of the body with respect to the axle are compensated for by means of the suspension connecting rod 30 which is mounted in spherical bearings at both ends. The relative displacements of the axle with respect to the chassis of the bogie are compensated for on the one hand by the arms 42, 44, which have a small transverse travel and, on the other hand, by the connecting link rod 54, which is mounted in spherical bearings at both ends. The reduction gearbox 18 is connected in terms of translation to the axle 6 which bears it.

Figure 5:
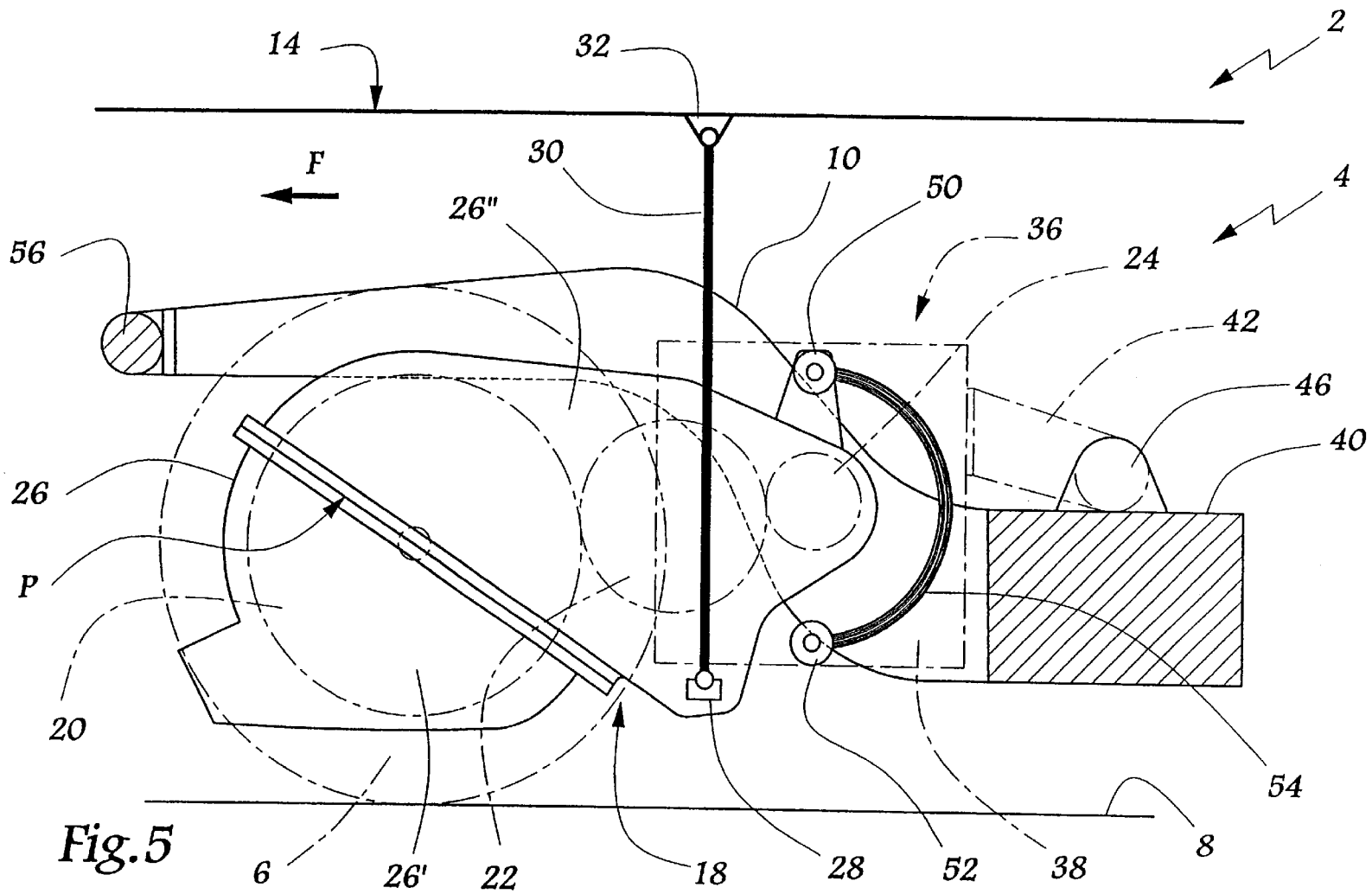
FIG. 5 is a view similar to FIG. 3, illustrating an alternative form of the invention.

FIG. 5 depicts an alternative form of the invention, in which the box 26 has a parting line P extending obliquely, so as to define two box elements 26', 26". The first element 26' extends only near to the axle 6 and the wheel 20, while the second element 26", suspended by the connecting rod 30, covers the wheels 22 and 24. It is thus possible to remove the first element 26' so as to remove the axle and its wheel 20 without having to operate on the wheels 22 and 24, which remain suspended from the connecting rod 30.

In the embodiments described hereinabove, the reduction gearbox 18 is suspended from the body of the vehicle, the motor being articulated on the one hand to the chassis of the bogie, and on the other hand, to the reduction gearbox. It is also conceivable to suspend the motor from the body, using a connecting rod similar to the connecting rod 30 depicted. In this case, the motor is also articulated to the chassis of the bogie and the reduction gearbox is suspended only from the motor, without being suspended directly from the body.

The invention makes it possible to achieve the aforementioned objectives. Specifically, it allows a significant part of the mass of the motor and of the reduction gearbox to be suspended vertically from the body. In this respect it should be noted that although the reduction gearbox and the motor are connected respectively to the axle and to the chassis of the bogie, they exert only light loads on these elements. Furthermore, the invention involves a very low number of mechanical parts because just one connecting rod allows the reduction gearbox to be suspended from the body, whereas another single link rod provides the mutual articulation between the motor and the reduction gearbox. These mechanical parts are robust, of simple design and of low cost.

The arrangement according to the invention generates very little transverse movement between the reduction gearbox and the motor. This guarantees optimum operation of the coupling that provides the transmission between this motor and this reduction gearbox and allows the mass of these elements to be reduced. Given that the reduction gearbox is longitudinally offset with respect to the axle, it is possible to place the braking discs on this axle, within the space which is thus available.

Arranging the centers of gravity of the motor and of the reduction gearbox respectively one on either side, when viewed from the side (FIGS. 1 and 3), of the point of articulation of the connecting rod for suspending the reduction gearbox, or the motor, from the body, is advantageous. This is because a configuration of this kind allows the moments exerted on this point of articulation both by the motor and by the reduction gearbox to compensate for each other. From this standpoint, it is particularly advantageous for these moments to cancel each other out, when the products of the masses of the reduction gearbox and of the motor, respectively, and the length of the corresponding lever arms are equal.

The fact that the center of gravity of the reduction gearbox and of the motor are arranged, when viewed from above (FIG. 4), one on either side of the point of articulation of the connecting rod for suspending the reduction gearbox or the motor is also advantageous. This gives the assembly formed by this motor and this reduction gearbox excellent stability in so far as this point of articulation is located pretty much at the center of inertia of this assembly.

What is claimed is:

1. A drive bogie for a rail vehicle, said drive bogie comprising:

axles resting on rails;

a chassis resting on said axles;

means for driving each axle, including a motor, a reduction gearbox and means of transmission between the motor and the reduction gearbox;

means being provided to allow the vehicle to support the drive means, wherein said means for supporting the drive means comprise means for suspending the reduction gearbox or the motor from the body of the vehicle, the suspension means being articulated to the reduction gearbox or to the motor, and to the body;

means for articulating the motor to the chassis of the bogie about a roughly horizontal axis; and means for connecting the motor to the reduction gearbox, the connecting means being articulated both to the motor and to the reduction gearbox.

2. The bogie according to claim 1, wherein the means for suspending the reduction gearbox or the motor from the body of the vehicle are articulated to the reduction gearbox or to the motor, and to the body, at least about a horizontal axis.

3. The bogie according to claim 2, wherein the suspension means comprise an approximately straight connection rod stretching roughly vertically between the reduction gearbox and the body of the vehicle.

4. The bogie according to claim 1, wherein the means for connecting the motor to the reduction gearbox are articulated to the motor and to the reduction gearbox at least about a horizontal axis.

5. The bogie according to claim 1, wherein the means of articulation of the motor to the chassis comprise two arms secured to the housing of the motor, the arms being articulated to the chassis about the horizontal axis.

6. A railway vehicle comprising at least one drive bogie and a body resting on the at least one drive bogie, wherein the at least one drive bogie is as claimed in claim 1.

7. A drive bogie for a rail vehicle, said drive bogie comprising:

axles resting on rails;

a chassis resting on said axles;

means for driving each axle, including a motor, a reduction gearbox and means of transmission between the motor and the reduction gearbox;

means being provided to allow the vehicle to support the drive means, wherein said means for supporting the drive means comprise means for suspending the reduction gearbox or the motor from the body of the vehicle, the suspension means being articulated to the reduction gearbox or to the motor, and to the body;

means for articulating the motor to the chassis of the bogie about a roughly horizontal axis; and means for connecting the motor to the reduction gearbox, the connecting means being articulated both to the motor and to the reduction gearbox, wherein, when viewed from the side, the point of articulation of the reduction gearbox or of the motor to the suspension means lies between the center of gravity (g) of the reduction gearbox and the center of gravity (g') of the motor.

8. The bogie according to claim 7, wherein the moment (m·d) exerted by the reduction gearbox on said articulation point is approximately equal to the moment (M·d') exerted by the motor on said articulation point.

9. A drive bogie for a rail vehicle, said drive bogie comprising:

axles resting on rails;

a chassis resting on said axles;

means for driving each axle, including a motor, a reduction gearbox and means of transmission between the motor and the reduction gearbox;

means being provided to allow the vehicle to support the drive means, wherein said means for supporting the drive means comprise means for suspending the reduction gearbox or the motor from the body of the vehicle, the suspension means being articulated to the reduction gearbox or to the motor, and to the body;

means for articulating the motor to the chassis of the bogie about a roughly horizontal axis; and means for connecting the motor to the reduction gearbox, the connecting means being articulated both to the motor and to the reduction gearbox, wherein, when viewed from above, the reduction gearbox and the motor are transversely offset with respect to each other, the point of articulation of the suspension means to the reduction gearbox or to the motor being located between the center of gravity (g) of the reduction gearbox and the center of gravity (g') of the motor.

10. A drive bogie for a rail vehicle, said drive bogie comprising:

axles resting on rails;

a chassis resting on said axles;

means for driving each axle, including a motor, a reduction gearbox and means of transmission between the motor and the reduction gearbox;

means being provided to allow the vehicle to support the drive means, wherein said means for supporting the drive means comprise means for suspending the reduction gearbox or the motor from the body of the vehicle, the suspension means being articulated to the reduction gearbox or to the motor, and to the body;

means for articulating the motor to the chassis of the bogie about a roughly horizontal axis; and means for connecting the motor to the reduction gearbox, the connecting means being articulated both to the motor and to the reduction gearbox, wherein the means for connecting the motor to the reduction gearbox are articulated to the motor and to the reduction gearbox at least about a horizontal axis, wherein the means for connecting the motor to the reduction gearbox comprise a link rod which, when viewed from the side, is in the shape of a C, the two ends of the link rod, one of them articulated to the motor and the other to the reduction gearbox, being located roughly one below the other.

11. A drive bogie for a rail vehicle, said drive bogie comprising:

axles resting on rails;

a chassis resting on said axles;

means for driving each axle, including a motor, a reduction gearbox and means of transmission between the motor and the reduction gearbox;

means being provided to allow the vehicle to support the drive means, wherein said means for supporting the drive means comprise means for suspending the reduction gearbox or the motor from the body of the vehicle, the suspension means being articulated to the reduction gearbox or to the motor, and to the body;

means for articulating the motor to the chassis of the bogie about a roughly horizontal axis; and means for connecting the motor to the reduction gearbox, the connecting means being articulated both to the motor and to the reduction gearbox, wherein the means of transmission between the motor and the reduction gearbox comprise a curved-tooth coupling.

12. A drive bogie for a rail vehicle, said drive bogie comprising:

axles resting on rails;

a chassis resting on said axles;

means for driving each axle, including a motor, a reduction gearbox and means of transmission between the motor and the reduction gearbox;

means being provided to allow the vehicle to support the drive means, wherein said means for supporting the drive means comprise means for suspending the reduction gearbox or the motor from the body of the vehicle, the suspension means being articulated to the reduction gearbox or to the motor, and to the body;

means for articulating the motor to the chassis of the bogie about a roughly horizontal axis; and means for connecting the motor to the reduction gearbox, the connecting means being articulated both to the motor and to the reduction gearbox, wherein the reduction gearbox comprises a driven wheel driven by the motor, a drive wheel secured to the axle and an intermediate wheel.

13. A drive bogie for a rail vehicle, said drive bogie comprising:

a rail vehicle body;

a plurality of axles resting on rails;

a chassis resting on said axles;

a motor for driving each axle;

a reduction gearbox;

a curved-tooth coupling for transmission between said motor and said reduction gearbox;

a substantially straight connection rod stretching substantially vertically between said reduction gearbox and said rail vehicle body for suspending said reduction gearbox or said motor from said rail vehicle body;

wherein said connection rod is articulated to said reduction gearbox and to said rail vehicle body, or to said motor and to said rail vehicle body;

a plurality of arms secured to said housing of said motor, said arms for articulating said motor to said chassis about a substantially horizontal axis; and a link rod for connecting said motor to said reduction gearbox, said link rod having a first end articulated to said motor and a second end articulated to said reduction gearbox, wherein said link rod, when viewed from the side, is in the shape of a C, and wherein said first end of said link rod is located substantially below said second end of said link rod.

14. The drive bogie according to claim 13, wherein said reduction gearbox comprises a driven wheel driven by the motor, a drive wheel secured to the axle, and an intermediate wheel.

15. The drive bogie according to claim 13, wherein, when viewed from the side, a point of articulation of said reduction gearbox or of said motor to said connection rod lies between a center of gravity (g) of said reduction gearbox and a center of gravity (g') of said motor.

16. The drive bogie according to claim 15, wherein a moment (m·d) exerted by said reduction gearbox on said point of articulation is substantially equal to a moment (M·d') exerted by said motor on said articulation point.

17. The drive bogie according to claim 13, wherein, when viewed from above, said reduction gearbox and said motor are transversely offset with respect to each other, wherein a point of articulation of said connection rod to said reduction gearbox or to said motor is located between a center of gravity (g) of said reduction gearbox and a center of gravity (g') of said motor.

18. The drive bogie according to claim 13, wherein said connection rod is articulated to said reduction gearbox and to said rail vehicle body, or to said motor and to said rail vehicle body, at least about a substantially horizontal axis.

19. A railway vehicle comprising at least one drive bogie and a rail vehicle body resting on the at least one drive bogie, wherein the at least one drive bogie is as claimed in claim 13.

* * * * *